United States Patent [19]

Bernardis et al.

[11] 4,232,976

[45] Nov. 11, 1980

[54] RIBBON CARTRIDGE FOR PRINTING MACHINES AND MECHANISM FOR FEEDING THE RIBBON

[75] Inventors: Francesco Bernardis; Paolo Prevignano, both of Ivrea, Italy

[73] Assignee: Ing. C. Olivetti & C., S.p.A., Ivrea, Italy

[21] Appl. No.: 863,420

[22] Filed: Dec. 22, 1977

[30] Foreign Application Priority Data

Dec. 29, 1976 [IT] Italy ..... 70118 A/76

[51] Int. Cl.[3] ..... B41J 33/10

[52] U.S. Cl. ..... 400/196.1; 400/195; 400/229; 400/235.1

[58] Field of Search ..... 400/194, 195, 196, 196.1, 400/208, 229, 235.1

[56] References Cited

U.S. PATENT DOCUMENTS

| | | | |
|---|---|---|---|
| 3,349,887 | 10/1967 | Goff | 400/235.1 X |
| 3,604,549 | 9/1971 | Caudill et al. | 400/208 |
| 3,758,012 | 9/1973 | Bonner et al. | 400/195 X |
| 3,841,459 | 10/1974 | Buschmann et al. | 400/229 X |
| 3,904,018 | 9/1975 | Denley | 400/196 |
| 3,939,957 | 2/1976 | Bittner | 400/229 X |
| 3,973,707 | 8/1976 | Pratt et al. | 400/196.1 X |
| 3,981,387 | 9/1976 | Gottschlich | 400/196 |
| 3,989,132 | 11/1976 | Carson | 400/196.1 X |
| 3,994,383 | 11/1976 | Best | 400/196.1 |
| 4,051,944 | 10/1977 | Starr | 400/195 |

FOREIGN PATENT DOCUMENTS

| | | | |
|---|---|---|---|
| 2136777 | 2/1973 | Fed. Rep. of Germany | 400/196.1 |
| 2551989 | 5/1976 | Fed. Rep. of Germany | 400/196.1 |

OTHER PUBLICATIONS

IBM Technical Disclosure Bulletin, "Ribbon Drive", Cross, vol. 15, No. 7, Dec. 1972, p. 2312.

*Primary Examiner*—Ernest T. Wright, Jr.

*Attorney, Agent, or Firm*—Schuyler, Banner, Birch, McKie & Beckett

[57] ABSTRACT

A cartridge for an inked ribbon for printing machines, in particular wire printers, comprises a container and a pair of rollers for the feeding of the ribbon. The container comprises a storage zone, in which an inked ribbon is disposed in loops and is distributed at random, and a guide zone which surrounds the printing head of the machine. The guide zone comprises a series of ribs which twists a section of the inked ribbon through 180° to form a Möbius loop. The rollers are free to move radially in corresponding seats of the container and are able to engage a pair of pins of the machine. One pin is a motor pin and rotates one of the rollers, and the other pin is a pressure pin which engages the other roller and is urged by a spring against the motor pin. The pressure pin causes the ribbon to be nipped between the two rollers to be fed by the motor pin.

3 Claims, 11 Drawing Figures

RIBBON CARTRIDGE FOR PRINTING MACHINES AND MECHANISM FOR FEEDING THE RIBBON

BACKGROUND OF THE INVENTION

The present invention relates to a cartridge for an inked ribbon for use in printing machines and the mechanism used to feed the inked ribbon. The cartridge comprises a container and a pair of rollers for the forward movement of the ribbon, one of the rollers being a motor roller operable from outside, and the other being a pressure roller to press the ribbon against the motor roller. Cartridges for inked ribbons of the type described are known in which the pressure roller is pressed against the motor roller by means of a spring fitted between one of the pressure roller supports and one of the cartridge seatings. The disadvantage of this arrangement is that the pressure load applied between the two feed rollers is entirely provided internally by the spring, with the result that the size of the cartridge must be such as to enable this load to be taken. Moreover, this assembly makes the cartridge rather expensive.

SUMMARY OF THE INVENTION

The object of the present invention is to produce a cartridge for inked ribbon that is simple, composed of few pieces and hence relatively cheap to manufacture and very simple to use.

According to the present invention there is provided a cartridge for an inked ribbon for printing machines and a feed mechanism for feeding the inked ribbon comprising a container and a pair of rollers for entrainment of the ribbon. One of the rollers is a motor roller operable from the outside and the other is a pressure roller to keep the ribbon pressed against the motor roller.

The container comprises a storage zone, in which the ribbon is disposed in loops and is distributed at random, and a guide zone which surrounds a head of a wire printer. The rollers are free to move radially in corresponding seats of the container and are able to engage a pair of pins of the wire printer.

BRIEF DESCRIPTION OF THE DRAWING

The invention will be described in more detail, by way of example, in the following description with reference to the accompanying drawing, in which.

DESCRIPTION ON THE PREFERRED EMBODIMENT

Figure 1:
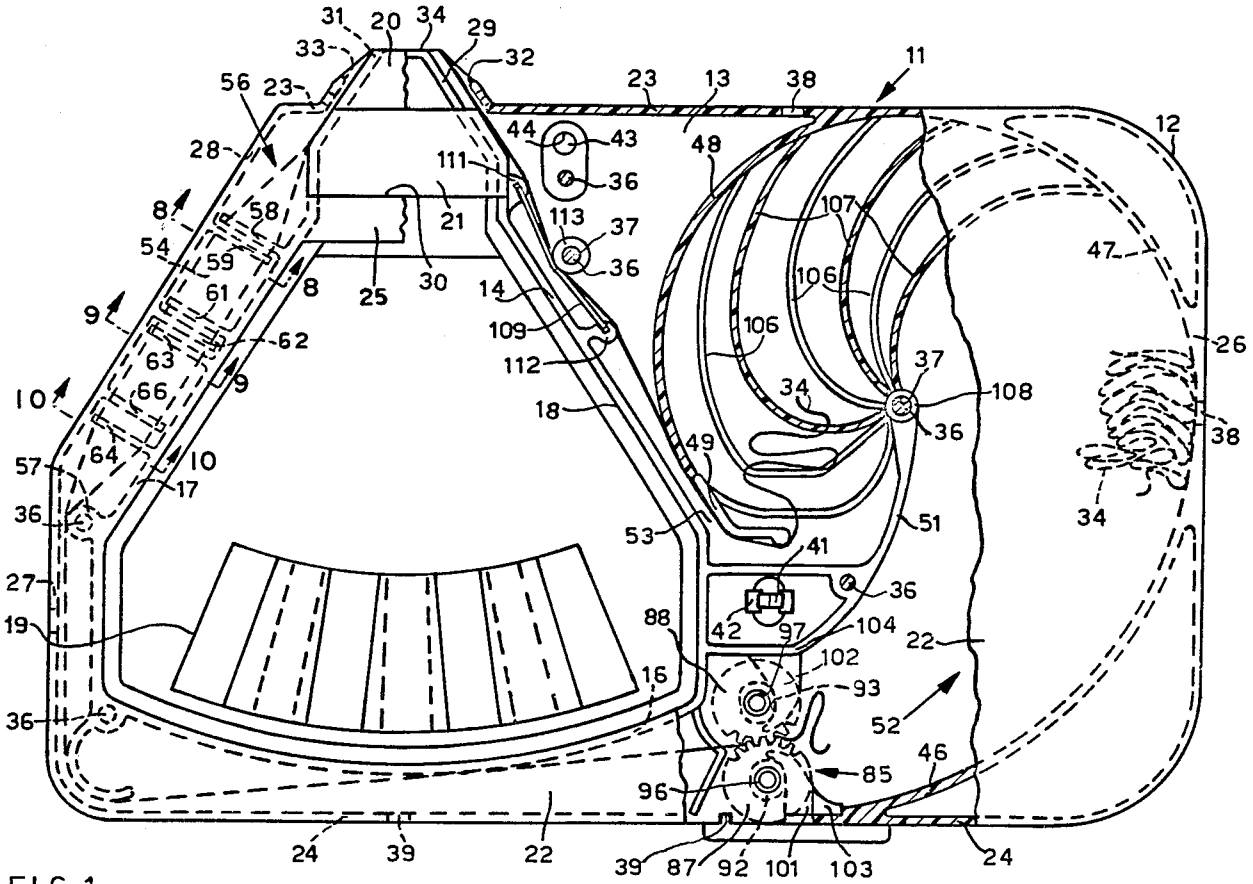
FIG. 1 is a partial plan view of an inked ribbon cartridge and a feed mechanism embodying the invention.

Referring to FIG. 1, an inked ribbon cartridge 11 comprises a plastic container 12. The container 12 is composed of a base 13 and a series of walls 14, 16 and 17 that make up a compartment 18 to house a wire printing head 19. Walls 14 and 17 are linked together, strengthened and made integral by a cross-piece 21 between their top parts. The top of the container 12 is closed by a lid or cover 22, a rear wall 23, a front wall 24, and side walls 26, 27 and 28. The lid 22 is attached to the container 12 by a series of pins 36 force-fitted into their respective seats 37 in the container 12, and by a plurality of tabs 38 housed in their respective grooves 39 in the base 13. The cartridge 11 also includes two arms 29 and 31 that project from the rear wall 23 and are closed at the top by a leaf 20 of the lid 22. The arms 29 and 31 are suitably shaped and have at their ends two apertures 32 and 33 for the admission and guidance respectively of a portion of an inked ribbon 34. Arms 29 and 31 are set in parallel and at an angle to the ends of the printing head 19 in such a way that the outer portion of the ribbon 34 is very small and almost touching the head 19. A second leaf 25 of the lid 22 forms, together with leaf 20, a seating 30 for the cross-piece 21.

The cartridge 11 is held motionless on a support 76 (FIG. 2) of a writing machine, shown in a general manner as 77, by means of a pin 41 (FIG. 1) engaged by two flexible tabs 42 of the container 12 and by a positioning pin 43 lodged in a hole 44. A series of inner walls 46,47,48,49 and 51 form the borders of a storage area or zone 52, in which the ribbon 34 is set in loosely distributed loops. The storage area 52 is to be found on one side of the head 19 and is of a substantially spiral shape. It has a slit or channel 53 bounded by walls 14 and 49 for the exit of the ribbon 34. The space allowed for the ribbon 34 gradually increases along the path of the ribbon 34 to the exit area.

Figure 8:
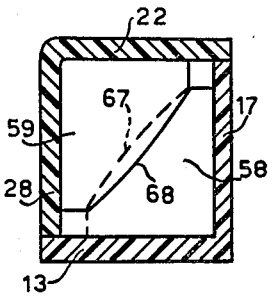
FIG. 8 is a partial section on the line 8—8 of FIG. 1.
Figure 9:
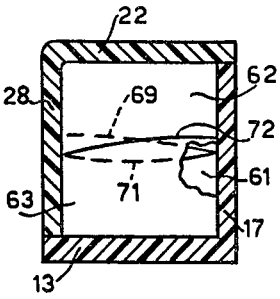
FIG. 9 is a partial section on the line 9—9 of FIG. 1.
Figure 10:
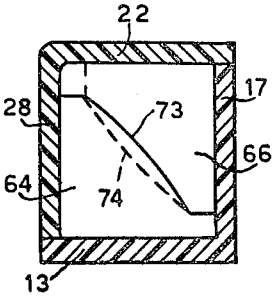
FIG. 10 is a partial section on the line 10—10 of FIG. 1.

A section 54 of the ribbon 34 is turned through 180° to form a Möbius loop in an inversion area, shown in a general manner as 56, set between aperture 33 and a guide support 57. The inversion area 56 consists of a first group of two ribs 58 and 59, protruding from the base 13 and the lid 22 respectively and serving to turn the section 54 of the ribbon 34 through 42° with respect to the vertical plane in which the said ribbon 34 is normally held, a second group of three ribs 61, 62 and 63, of which rib 61 protrudes from the base 13 and turns the section 54 through 83°, rib 62 projects from the lid 22 between ribs 61 and 63 and turns the section 54 through 90° to bring it parallel with the base 13, and rib 63 protrudes from the base 13 and turns the section 54 through 97°, and a third group of two ribs 64 and 66, projecting from the base 13 and the lid 22 respectively and serving to turn the section 54 through 138° with respect to the vertical plane. Each rib 58 (FIG. 8), 59,61 (FIG. 9), 62,63,64 (FIG. 10), and 66 has a guiding edge 67 (FIG. 8), 68,69 (FIG. 9), 71,72,73 (FIG. 10), and 74 designed to operate in conjunction with both sides of the ribbon 34 alternately (FIG. 1).

The printing machine 77 (FIG. 2) includes the support 76 carrying the printing head 19, and a roller 78 supporting a sheet of paper 79. A helical shaft 81 and a motor 82 slide the support 76, under the guidance of a guide 80, between the sides 83 and 84.

Figure 3:
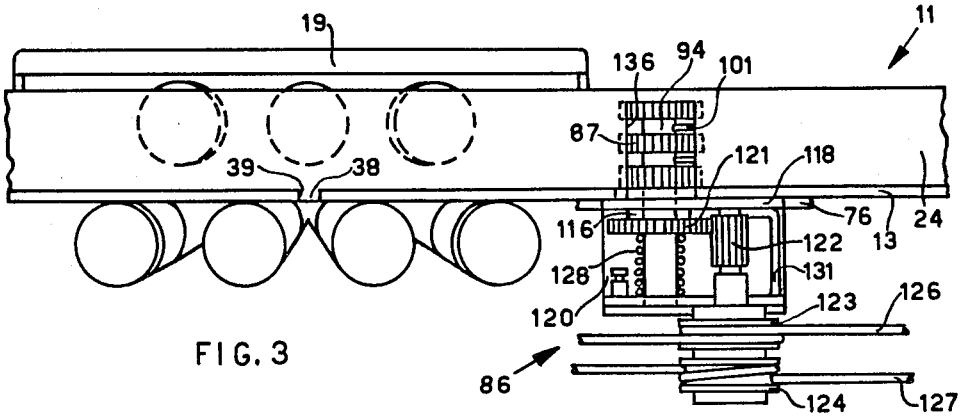
FIG. 3 is a partial front view of the printing machine, illustrated in FIG. 2, showing the ribbon feed mechanism.

The cartridge 11 (FIG. 1) is supplied with a pair of rollers, shown in a general manner as 85, for the one-way feed of the ribbon 34. The rollers 85 operate in conjunction with a feed device, shown in a general manner as 86 (FIG. 3), and comprise (FIG. 4) a motor roller 87 and a pressure roller 88, designed to be engaged by a motor pin 89 and an opposing pin 91 respectively of the feed device 86. Both the motor roller 87 and the pressure roller 88 are free to move radially in their respective seats 92,93 in the cartridge 11, the seats 92,93 consisting of an aperture in the base 13 and lid 22. Each roller 87,88 is formed of three identical, coaxial toothed gear wheels, separated from each other by a sleeve 94. The ends of each roller 87,88 are fitted with two sleeves 96 and 97 respectively designed to engage with the seats 92,93 of the cartridge 11 respectively. Each roller 87,88 has a hollow part 98 and 99 respectively coaxial with the gear wheels to receive the motor pin 89 and the opposing pin 91 respectively.

Figure 7:
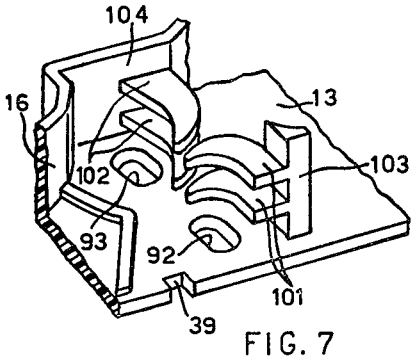
FIG. 7 is a view in perspective of a number of details of FIG. 1.

The cartridge 11 (FIG. 1) comprises two pairs of tabs 101 and 102 that surround the sleeve 94 (FIG. 4) of the motor roller 87 and pressure roller 88 respectively and have a guide profile that projects beyond the teeth of the rollers 87 and 88 to withdraw the ribbon 34 (FIG. 1) from the gear wheels and convey it to the storage area 52. Each pair of tabs 101 and 102 (FIG. 7) is placed alongside the seats 92 and 93 and the tabs 101,102 themselves are integral with two supports protruding from the base 13, namely 103 and 104 respectively.

Lastly, the cartridge 11 (FIG. 1) comprises a leaf spring 109 set between two elements 111 and 112 integral with the inner wall 14. The said spring 109 presses the ribbon 34 against a pin 113. Inner walls 14,17 and 16 and walls 48,28 and 24 make up a channel for the ribbon 34 that completely surrounds the printing head 19.

Figure 4:
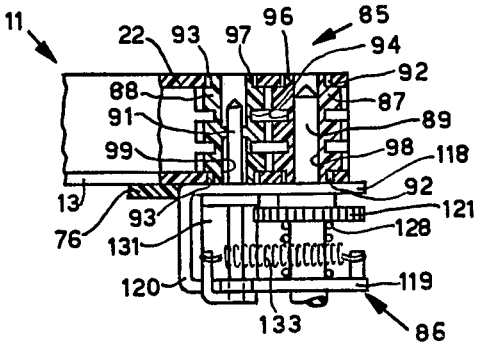
FIG. 4 is a partial section of a number of the details of FIG. 3.

To mount the rollers 87 and 88 (FIG. 1) on the cartridge 11, tabs 101 and 102 are engaged with the sleeve 94 (FIG. 4). A light pressure is then exerted to bend tabs 101 and 102 (FIG. 7) and the supports 103 and 104 until the sleeves 96 and 97 (FIG. 4) engage the corresponding seats 92 and 93 in the base 13. Next, the ribbon 34 is mounted on the base 13, and the lid 22 is attached to complete the assembly of the cartridge 11.

The base 13 (FIG. 1) and the lid 22 respectively comprise a series of ribs 106 and 107 that project towards the inside of the container 12, but are staggered with respect to each other to make the ribbon 34 follow a twisted path. The ribbon 34 is usually piled up against the inside walls 46,47 and 48 of the storage area 52. Ribs 106 and 107 are substantially spiral in shape. They start from walls 47 and 48 and converge on a central pin 108, with the result that they guide the loops of the ribbon 34 in such a way as to take them away from the walls 47 and 48 towards the centre of the spiral storage area 52 and reduce their density during the conveyance of the ribbon 34 towards the channel 53. The motor pin 89 (FIG. 6) is integrally mounted on a sleeve 116 that can turn in two seats 117 (one only is shown in the drawing) of two plates 118 (FIG. 5) and 119 of a bridge 120 fixed to the support 76. Sleeve 116 includes a gear 121 constantly engaged with a sprocket 122 which turns between plates 118 and 119. The sprocket 122 is connected to two pulleys 123 (FIG. 3) and 124 each of which has a known freewheel device (not shown in the drawing) such as the one-way clutch 29 shown in FIG. 2 of Bittner U.S. Pat. No. 3,939,957.

Two wires 126 and 127 are wound in opposite directions to each other around their respective pulleys 123 and 124. Thus when one wire turns its pulley, the other pulley remains idle and vice versa, so that the sprocket 122 always rotates in the same direction. A spring 128 usually holds the sleeve 116 against the top plate 118. Above, sleeve 116 (FIG. 6) has a toothed catch 129 designed to engage with sleeve 96 of motor roller 87 for entrainment of the roller 87.

The opposing pin 91 (FIG. 5) is attached to a bridge 131 turning on a pin 132 of bridge 120. A spring 133 usually holds pin 91 against the side of a groove 134 of bridge 120.

Figure 2:
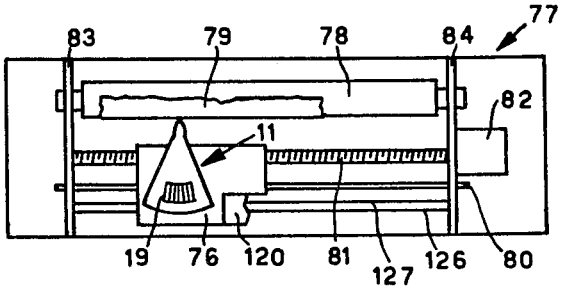
FIG. 2 is a partial diagrammatic plan view, on a reduced scale, of a printing machine on which the cartridge of FIG. 1 has been mounted.
Figure 5:
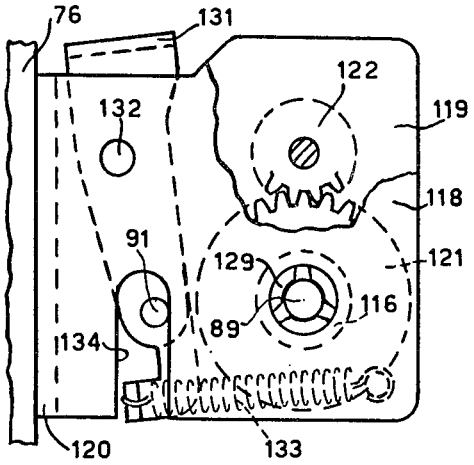
FIG. 5 is a partial plan view on a larger scale of a number of the details of FIGS. 3 and 4.
Figure 6:
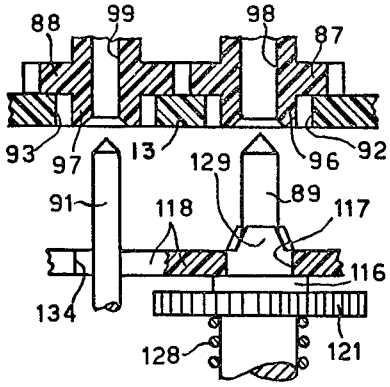
FIG. 6 is a partial view of a number of the details of FIG. 5 during one stage of the mounting of the cartridge on the machine.

To mount the cartridge 11 (FIG. 2) on the machine 77, pin 43 (FIG. 1) is first engaged with hole 44. Pin 41 is then inserted between the flexible tabs 42. Light pressure is applied to the lid 22 and the cartridge 11 is lowered until the base 13 comes to rest against the support 76 (FIG. 2). During this operation, pins 89 and 91 (FIG. 6) are in the position shown in FIG. 6, i.e. pin 91 is against the side of groove 134. The motor pin 89 engages the hollow part 98 so as to move the motor roller 87 radially in seat 92, while the opposing pin 91 engages the corresponding hollow part 99 with the result that the pressure roller 88 moves radially in its seat 93 and the opposing pin 91 is shifted away against the action of spring 133 (FIG. 5). When the cartridge 11 is mounted on support 76, spring 133 pushes bridge 131 anticlockwise in such a way as to bring the opposing pin 91 with the pressure roller 88 (FIG. 1) against the motor roller 87, so that a section of the ribbon 34 is pinched between the two rollers 87 and 88.

The ribbon 34 may go slack between apertures 32 (FIG. 1) and 33 during the mounting of the cartridge 11 on the machine 77, or during its dismounting from the same (FIG. 2). To meet this situation, the cartridge 11 includes an opening 136 (FIG. 3), through which the motor roller 87 can be turned by hand so as to tauten the ribbon 34.

It is to be understood that modifications and improvements can be made to either the shape or the arrangement of the various elements and parts of which the cartridge 11 is composed without thereby going outside the ambit of the present invention.

In particular, the base 13 (FIG. 1) of the cartridge 11 in an alternative embodiment includes a first grove 141 (FIG. 11), adjacent and parallel to inner wall 16 and connected to seat 93, a second groove 142, set between seats 92 and 93, and a third groove 143, set between seat 92 and an outer edge 144 of the base 13. Grooves 141,142 and 143 and edge 144 form the boundary of a flexible tab 146 belonging to the base 13, which enables automatic equipment to be used to mount rollers 87 and 88 (FIG. 1) on the cartridge 11 in the following manner.

Figure 11:
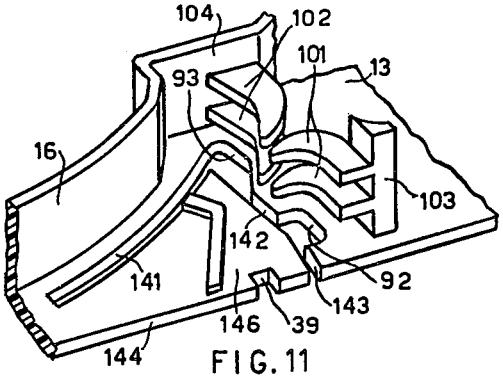
FIG. 11 is a modified form of FIG. 7.

Rollers 87 and 88 are laid on the outermost edge of tab 146 alongside seats 92 and 93. By exerting pressure in a substantially vertical manner on base 13, one bends tab 146 (FIG. 11) to bring the sleeves 94 (FIG. 3) in front of tabs 101 and 102 (FIG. 11). Rollers 87 and 88 (FIG. 6) are then pushed so as to house them with sleeves 96,97 in their respective seats 92,93. Tab 146 (FIG. 11) is thus released and returns elastically to its original position. Subsequent soldering of the lid 22 to the base 13 provides a firmer support for rollers 87 and 88.

We claim:

1. A cartridge for an inked ribbon for a printing machine comprising a container having a base, a lid, a series of inner walls defining a storage zone and an inked ribbon disposed in loops distributed at random in said storage zone wherein the storage zone comprises an entrance area, an exit area and a slit, said storage zone being spiral shaped to increase the space for the ribbon from the entrance area to the exit area, said inked ribbon extending through the slit to the exterior of the storage zone, wherein the base and the lid comprise a series of ribs projecting towards the inside of the storage zone, staggered with respect to each other and substantially spiral shaped so as to take the loops of the inked ribbon away from the inner walls and reduce the density of said loops from the exit area to the slit.

2. A ribbon cartridge for printing machines of the type including a support and a ribbon feed mechanism comprising a motor pin and a pressure pin, bridge means supporting said pressure pin for the movement thereof with respect to the motor pin and spring means operative on said bridge means for urging said pressure pin towards said motor pin, said cartridge comprising:

a container including a base, a cover and a series of inner walls defining a storage zone and means defining opposed aligned seats on said base and said cover;

a ribbon disposed in loops distributed at random in the storage zone of said container;

a pair of rollers supported by said container comprising a motor roller and a pressure roller to keep the ribbon pressed against the motor roller for feeding of said ribbon towards and away from the storage zone, said motor roller being engaged by said motor pin and said pressure roller being engaged by said pressure pin when the cartridge is mounted on said support;

at least said pressure roller comprising a part engageable with the pressure pin for the movement thereof away from said motor pin upon mounting of the cartridge on said support, and at least said pressure pin being free to move radially in the seat of the base and the seat of the cover of said container for causing said spring to press the pressure roller against the motor roller when said pair of rollers engages said pair of pins, each of said rollers comprises a plurality of identical and coaxial toothed wheels and an intermediate sleeve between said plurality of toothed wheels;

said container further comprises a pair of tabs disposed near said seats and integral with said base, said pair of tabs disposed between the toothed wheels adjacent said intermediate sleeve to surround the motor roller and the pressure roller respectively for extracting the ribbon from the toothed wheels;

said tabs being flexibly supported on support means which enables mounting of the sleeves of said rollers in said seats of said container with the rollers free to move in corresponding seats of said base and cover;

said support means comprising a flexible portion of the base of said container from which project said tabs, said flexible portion being defined by a first groove connected to the seat of the pressure roller, a second groove disposed between and interconnecting said seats of said rollers, and a third groove connecting the seat of the motor roller to an adjacent outer edge of said base.

3. An inked ribbon cartridge for a wire printing head comprising an inked ribbon and a container for said inked ribbon comprising:

a base;

a lid;

an inner wall for surrounding the wire printing head and defining a ribbon storage zone on one side of said wire printing head for storing loops of said ribbon;

an outer wall defining a channel for the inked ribbon surrounding the wire printing head from an aperture at a point of exit from the storage zone to a terminal zone adjacent to the printing head and from the terminal zone on the exterior of the container to another aperture at an entrance to the storage zone;

means for directing the loops of the inked ribbon away from the inner wall to reduce the density of said loops adjacent to the point of exit;

said inked ribbon being normally guided and held in a vertical plane substantially perpendicular to the base and the lid of said container, and wherein said container comprises a series of ribs protruding in said channel for turning a section of the inked ribbon through 180° to form a Möbius loop, the ribs being arranged to protrude from both the base and the lid respectively and comprise a first group of two ribs adjacent to one of said apertures and opposed to each other for turning the inked ribbon through approximately 45° with respect to said vertical plane, a second group of three ribs for turning the inked ribbon and setting said ribbon in a substantially horizontal plane with respect to said vertical plane, and a third group of two opposed ribs for turning the inked ribbon through approximately 135° with respect to said vertical plane.

* * * * *